US007707938B2

(12) United States Patent
Hisel

(10) Patent No.: US 7,707,938 B2
(45) Date of Patent: May 4, 2010

(54) APPARATUS AND METHOD FOR AVALANCHE CONTROL

(76) Inventor: Stanley D. Hisel, P.O. Box 621861, Littleton, CO (US) 80162

( * ) Notice: Subject to any disclaimer, the term of this patent is extended or adjusted under 35 U.S.C. 154(b) by 934 days.

(21) Appl. No.: 10/908,546

(22) Filed: May 16, 2005

(65) Prior Publication Data

US 2006/0254449 A1 Nov. 16, 2006

(51) Int. Cl.
*F42D 3/00* (2006.01)

(52) U.S. Cl. ..... 102/302; 89/1.11

(58) Field of Classification Search ..... 102/302, 102/301; 89/1.11, 1.14, 1.1
See application file for complete search history.

(56) References Cited

U.S. PATENT DOCUMENTS 1,344,988 A * 6/1920 Clifford ..... 239/132.3
1,441,488 A * 1/1923 Donigan ..... 239/431
1,835,723 A * 12/1931 Salzer ..... 239/416.4
2,181,095 A * 11/1939 Ness ..... 432/23
2,417,981 A * 3/1947 Graham ..... 431/91
2,622,667 A * 12/1952 Hinton ..... 239/414
2,886,424 A * 5/1959 Hyslop, Jr. ..... 149/1
2,925,038 A * 2/1960 Brooks ..... 102/302
2,939,410 A * 6/1960 Karpuk et al. ..... 431/29
2,975,002 A * 3/1961 Thomas et al. ..... 406/56
3,038,408 A * 6/1962 Kluge ..... 102/381
3,150,848 A * 9/1964 Lager ..... 244/3.16
3,179,371 A * 4/1965 Charlop ..... 251/321
3,642,547 A * 2/1972 Conrad ..... 149/2
5,062,791 A * 11/1991 Liou ..... 431/266
5,107,765 A * 4/1992 Schippers ..... 102/302
5,223,661 A * 6/1993 Sabri ..... 89/1.13
5,249,500 A * 10/1993 Husseiny et al. ..... 89/1.11
5,419,257 A * 5/1995 Leichter et al. ..... 102/315
5,874,688 A * 2/1999 Lubbe et al. ..... 86/20.15
6,279,481 B1 8/2001 Schippers ..... 102/302
6,324,982 B1 12/2001 Eybert-Berard et al. ..... 102/363

FOREIGN PATENT DOCUMENTS

GB 2012926 A * 8/1979
GB 2397374 A * 7/2004

OTHER PUBLICATIONS

Brown, C. B., Evans, R. J., Johnson, J. B., Lachapelle, E. R., Langdon, J. A., Moore, M. B., and Taylor, P. L., Alternate Methods Of Avalanche Control, Jul. 1975, National National Technical Information Service, Publication PB247274, pp. 1-46.

* cited by examiner

*Primary Examiner*—Troy Chambers
(74) *Attorney, Agent, or Firm*—Kyle W. Rost

(57) ABSTRACT

At least two gases combine to form a detonable mixture that is detonated near an avalanche start zone. Each gas is separately supplied at a pressure above ambient pressure so that the pressure differential drives the gases through a mixer and to deploy as a detonable cloud in open air near the start zone. An igniter is located in communication with the detonable cloud near its discharge point from the mixer so that the igniter will be in communication with the cloud near the end of a predictable time interval. A controller releases the gases to initiate the mixing and deployment of the gas cloud and measures the interval. At the end of the predictable time interval, the controller fires the igniter to detonate the explosive gas mixture in open air.

17 Claims, 6 Drawing Sheets

APPARATUS AND METHOD FOR AVALANCHE CONTROL

BACKGROUND OF THE INVENTION

1. Field of the Invention

The invention generally relates to ammunition and explosives. More specifically, the invention relates to blasting and terrain clearance. Another specific aspect of the invention relates to fuel air explosive. The invention is a device and method for artificially triggering an avalanche, such as a snow avalanche.

2. Description of Related Art Including Information Disclosed Under 37 CFR 1.97 and 1.98

Avalanche control is a safety practice by which known snow slide areas are artificially triggered to release a snow slide or avalanche. Such artificial release reduces the possibility that an avalanche will occur at another time or in greater volume. Avalanche control is especially important in ski areas, where an unexpected avalanche might threaten human safety. Avalanche control also is important near mountain highways, where an unexpected avalanche might damage or close a road, in addition to threatening vehicles and human safety. Consequently, managing avalanches offers the advantage of causing the avalanche to take place at a planned, favorable time, such as when people and vehicles are not present and when any necessary machinery and equipment is available.

A basic method of releasing an avalanche is by use of an explosive to dislodge the snow. Various types of explosive charges are in use. Placing or throwing a charge of TNT is effective. However, such a method involves the difficulties and dangers of storing and directly handling explosives.

A method of avalanche control in common use in the United States is to fire an artillery shell at the snow slide area. The exploding shell can trigger an avalanche. If the avalanche fails to release, additional artillery shells can be fired. This method has the advantage of being simple, effective, and flexible. The artillery gun can be fired from a safe distance and repositioned as necessary to fire at additional snow slide areas. However, storing functional artillery guns and shells can be a public danger, since such equipment can be misappropriated and misused. For this reason, artillery guns and shells are being retired from use in avalanche control.

In 1975, the Washington University, Seattle, Dept. of Civil Engineering, reported a study titled "Alternate Methods of Avalanche Control," published by the U.S. Department of Commerce. This study investigated several methods of releasing snow slides by mechanical action or explosive force applied from below the snow.

According to the first reported method, inflatable air bags were placed in known snow slide zones prior to snowfall. After snowfall, the air bags were inflated in an attempt to trigger the release of an avalanche. This method had many problems, including the inability to adjust bag placement once the snow layer was in place, various types of bag failures, and danger that the bags would slide with the avalanche.

In the second reported method, explosive gas was detonated in various types of chambers installed before snowfall. One device was a steel cylinder that constituted an explosion chamber. The chamber carried a movable lid mounted on guide rods and held by return springs. After snow had buried the chamber, explosive gas injected into the chamber was detonated to explosively raise the lid from the cylinder. The rising lid and escaping gas from the explosion disrupted the covering snow. In a second variation of an explosion chamber, a length of metal pipe was perforated with holes. After being buried by snow, the pipe was filled with explosive gas, which was detonated. The explosion passed through the perforations to directly disrupt the snow. In a third explosion chamber, a large truck tire and rim were used without a split ring so that part of the rim could move. The explosive gas was introduced into the tire and detonated. According to the study, these gas exploder systems were not uniformly reliable for triggering avalanches.

Other types of gas exploders deliver a detonation and shock wave above the snowfield. U.S. Pat. No. 5,107,765 to Schippers teaches the use of a gas gun in the form of an explosion chamber configured as a tank with a discharge port pointed in the direction of the slope where the avalanche is to be triggered. The gas gun must be solidly anchored to the mountainside. Anchoring such a gas gun to a sufficiently solid foundation is difficult, particularly where native rock is crumbling. Further, the vibrations from explosions in the gas gun tend to fracture the foundation, damaging the mountain environment and requiring periodic remounting of the gas gun. During winter conditions, likely it is impossible to rebuild a foundation for the gas gun, resulting in loss of avalanche control at the site for the remainder of the season.

U.S. Pat. No. 6,279,481 to Schippers discloses a device characterized as an explosive hammer for dislodging cornices. A structure likened to the hammerhead is an explosion chamber configured as a hollow cylinder with closed top and open bottom. A structure likened to the hammer handle is an arm connected to the hollow cylinder and anchored to a mountainside by a pivot. A foundation secures the end of the arm to the mountainside. After a cornice forms over the cylinder, the explosion chamber is filled with explosive gas, which is detonated. Upon detonation, the gas raises the explosion chamber from the ground. The gas can escape from the open bottom of the explosion chamber. The discharging gas and the rise and fall movement of the explosion chamber combine to dislodge the cornice. However, over time the stress from the confined explosion and the hammering motion of the cylinder are likely to degenerate local rocks or the foundation.

Explosion chambers present additional limitations. For safety, combustible gases and oxidizing gases are not mixed prior to the approximate time of the intended explosion. The two types of gas are fed into the explosion chamber, where a degree of mixing takes place. However, short term mixing tends to be imperfect, which can reduce explosive yield when the mix is detonated. The explosion chamber may further limit explosive yield by preventing access to ambient oxygen, which otherwise might supplement the imperfect mixing within the chamber.

U.S. Pat. No. 6,324,982 to Eybert-Berard et al teaches a one-time-use explosion chamber similar to a butyl rubber weather balloon to hold explosive gas above the snowfield. Detonating the gas in the balloon destroys the balloon and generates an aerial pressure wave for releasing an avalanche. Such a frangible explosion chamber offers an advantage, as the balloon suffers no problems with degenerating foundations. However, handling and positioning a large balloon in the typically windy conditions of a mountaintop cause this solution to be impractical. Also, mountain locations are notable for having many hungry rodents, which often eat plastic, rubber, and almost any other material they can gnaw. The balloons are to be preinstalled in containers on a mountain and connected to a gas supply tube system. Quite likely the balloons, any nonmetallic portions of the containers, and any nonmetallic gas supply lines would present a food source to the rodents and quickly become non-operational.

It would be desirable to create an avalanche control system that is conveniently used in the often-difficult conditions on a mountaintop, that enjoys the relative safety and convenience of using explosive gases, but that does not tend to fracture its foundation or the rock structures of the mountain.

It would be desirable to create an avalanche control system that employs a combustible gas mixed with an oxidizing gas, in which ambient oxygen is readily available to the mixture to ensure good explosive yield.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide an avalanche control system that employs explosive gas ignited in open air.

According to the invention, an avalanche control apparatus employs an open air gas explosion to trigger an avalanche. The apparatus includes suitable sources of at least two gases that can be combined to form a detonable mixture. These gases may comprise a combustible gas and an oxidizing gas. Each gas is supplied at a pressure above atmospheric pressure so that the pressure differential from atmosphere drives the gases to mix and deploy as a detonable cloud, in open air, and in communication with an igniter at a known location, in a predictable time interval. A controller initiates the mixing and deployment of the gas cloud. Within the predictable time interval, the controller fires the igniter to detonate the explosive gas mixture in open air.

The apparatus provides a means for mixing the two gases to form the explosive gas mixture. A suitable means for mixing the two gases includes a means for directing the gases into mixing contact in a mixing area and for directing the mixed gases toward a point of use. The mixing means is adapted to receive the two gases under greater than atmospheric pressure, to mix the two gases to form an explosive gas mixture, and to further mix the explosive gas mixture with ambient air.

The igniter is juxtaposed to the mixing area and is in communication with the gas mixture at the point of use. The controller synchronizes the operation of the igniter with the projected location of the mixed gases to fire at a suitable time to ignite the explosive gas mixture in open air.

The controller contains a microprocessor that executes programmed instructions to regulate the release of component gases for mixing and the subsequent firing of the igniter. The microprocessor sequences the mixing of component gases and detonation of the mixture in open air.

According to a method of the invention, an explosive batch of mixed gases is detonated in open air in proximity to an avalanche start zone to trigger release of an avalanche. According to the method, at least two component gases are provided, initially at greater than atmospheric pressure. The two gases are chosen such that, when mixed together, they form an ignitable, explosive gas mixture. The predetermined quantity of each of the two gases is mixed to form an ignitable, explosive gas mixture. At a first preselected time, the predetermined quantity of each gas is delivered at greater than atmospheric pressure into a mixing area in a manner such that the two gases mix with the one another to form a batch of mixed gas. The batch of mixed gas is then located in open air, in communication with an igniter. At a second preselected time subsequent to and coordinated with the first preselected time, and while the mixed gas is in communication with the igniter, the igniter fires to ignite the batch, thereby producing an explosion in open air. The explosion generates an airborne shockwave suitable for triggering release of an avalanche from the avalanche start zone.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

Figure 1:
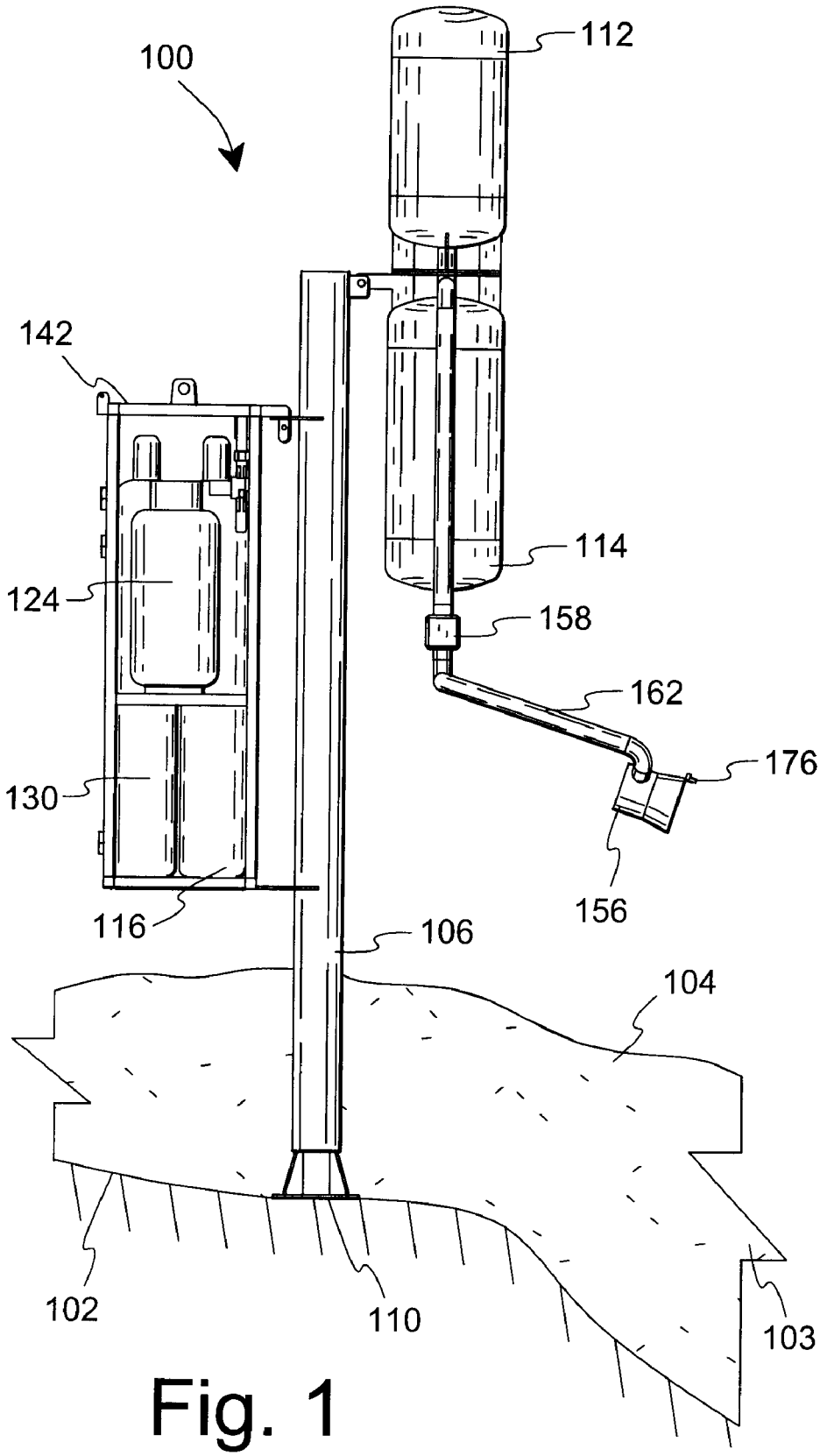
FIG. 1 is a side elevational view of the exploder, showing a representative mounting location.

The invention is an apparatus and method for mitigating avalanche danger in known avalanche slide paths. The invention, which will be generally called an "exploder," provides a substantially unconfined batch, charge, cloud, or body of explosive gas that is detonable to produce an airborne shockwave for triggering the release of an avalanche. Associated equipment for storing, delivering, mixing, and detonating the gas body can be installed near the area of the known avalanche slide path. The substantially unconfined character of the detonable gas body reduces the degree of shock and vibration delivered to the associated equipment, as compared to prior art equipment that employs an explosion chamber that houses the exploding gas charge. Thus, the method and apparatus of the invention provides a suitable explosion to trigger an avalanche while the equipment delivering the gas charge experiences greatly reduced shock due to the explosion being in open air, protecting both the equipment and the structure of the mountainside terrain where the equipment is located.

As a general guideline, triggering an avalanche requires a force equivalent to the explosion of at least seven pounds or three kilograms of TNT. The explosion of one gram of TNT supplies one thousand calories. Using this information, it is possible to calculate the volume of various explosives that would be equivalent to three kilograms of TNT. Thus, it is readily possible to determine an effective quantity of various explosives. U.S. Pat. No. 6,324,982 issued Dec. 4, 2001 to Eybert-Berard et al provides an enabling sample calculation for a mixture of hydrogen and air, thus guiding similar determinations for other gas mixtures. The teachings of U.S. Pat. No. 6,324,982 are hereby incorporated by reference for this purpose.

FIGS. 1-5 illustrate the structure of the exploder 100. The components include a means for supplying component gases in a suitable ratio and quantity to form a detonable gas body that, when detonated at an avalanche start zone, is sufficient to trigger release of an avalanche. The components further include a means for receiving and mixing the metered gases, a means for locating or discharging mixed gases to open air as a detonable gas body or gas cloud, and a means for igniting the gas cloud in open air. A support structure carries the aforesaid components in operable relationship. An electronic controller times and sequences the operation of the exploder. The controller actuates the release of the component gases to the mixer for mixing. At a subsequent time, the controller fires the igniting means after allowing a suitable time interval for the mixed gas to discharge from the mixer to open air in igniting proximity to the igniting means, thereby detonating the mixed gas body in open air.

In use, the exploder 100 includes a means for mounting the support structure in an area useful for artificially triggering release of an avalanche. In theory, the support structure might be portable. However, the frequent reality of operating in mountainous areas is that equipment should be pre-positioned before the winter, since moving equipment into close access to avalanche start zones during winter can be difficult.

The components of the exploder 100 are best located near an initiation zone, known as the "start zone" near the top of an avalanche slide path. Such zones are readily identified or known by experts, such as professional avalanche control personnel. Terrain analysis also is helpful to identify potential slide zones and start zones. Of course, empirical observation over long periods of time also allows identification of avalanche paths and start zones.

Various studies have attempted to characterize the physical qualities of start zones and slide paths in order to enable prediction of their location. The most important characteristic appears to be slope angle. The start zone often has a slope angle between thirty and forty-five degrees, while the avalanche path may have a more gentle slope angle between twenty and thirty-five degrees. Some reports suggest a slope angle as low as twenty-five degrees is suitable for a start zone. Steeper slopes, such as forty to sixty degrees, might be suitable for start zones, although such angles can be too steep for sufficient snow accumulation. Another relevant characteristic is the aspect of the slope relative to prevailing wind direction. Snow slabs on slopes downwind or parallel to prevailing wind direction appear to be more prone to avalanches. The shape of the terrain favors an avalanche on convex slopes, steep planar slopes, and along ridges with cornices. Start zones tend to be in open, non-forested areas, especially rocky surfaces above tree line. These physical characteristics enable prediction of a start zone and slide path by inspection of terrain.

Avalanche slide paths not only can be identified by inspection, but also by empirical observation. Over the course of years such slide paths are empirically identified by the natural and repeated occurrence of avalanche slides. Thus, in areas where long-term records are available, such as at ski areas and along mountain roadways, avalanche slide paths and start zones are identified by observation.

As suggested by FIG. 1, an appropriate mounting location for exploder 100 typically will be on a mountainside 102, near avalanche start zone 103 at the top of a known slide path, often along a ridge. Various components of the exploder are best mounted on an elevated support structure such as a mounting mast 106, suitable to support the components above the level of expected accumulated snow 104. A pilot shaft 108, FIG. 3, carried on a bolt-down mounting flange 110 serves as a means for attaching the mast 106 to the mountainside 102. The pilot shaft 108 may be fixed to the ground, while the mast and its attachments can be removed and replaced as necessary, such as by helicopter transport. Any of various types of supplemental fasteners such as bolts may secure the base flange to a suitable pad or foundation. Optionally, the mast 106 and pilot shaft 108 may be keyed together to support the mast in a single rotational position. For example, the pilot shaft and mast may engage by telescoping structures configured such that the mast cannot rotate on the pilot shaft.

The means for supplying component gases may include a dispenser that meters the gases in a desired ratio. An accumulator tank for each gas is suitable to measure, contain, and dispense each gas. An accumulator tank contains and dispenses a quantity of one gas suitable for one operational cycle of the exploder. The mast 106 carries two or more accumulator tanks. One of the gaseous components can be characterized as a combustible agent, and another of the components can be characterized as an oxidizing agent. For safety reasons, the two gases are stored and handled separately until mixed immediately prior to detonation. More than two gases may be employed, as desired. Impurities in the component gases are acceptable and expected, although they should be substantially harmless to the eventual mixing and detonation of the gases.

Propane gas is a preferred combustible agent because of its broad acceptance, wide availability, safety of storage and use, and standardized handling equipment. Other combustible gases are suitable and may be selected for use in the explosive mixture. Examples of other suitable combustible gases include acetylene, hydrogen, and butane. Combustible gas may be obtained from a source that is in any state, such as either liquid or gas.

When propane is selected as the combustible gas, the relative volumes of the accumulator tanks and available gas pressures are selected to produce approximately a 5:1 ratio of oxygen to propane in an end mixture. Propane may be used as a representative example of a combustible gas. Further examples may use the properties of propane when describing the structure and operation of the exploder 100. The naming of a specific gas should be understood to be by way of example and not limitation. Structural details of the exploder 100 often will be designed for handling propane and may be unsuitable for handling a different combustible gas. Therefore, for use with any other combustible gas than propane, the exploder 100 may require suitable modification for properly handling the chosen gas.

A first accumulator tank 112 is sized to contain an oxidizing gas in a first preselected quantity. A second accumulator tank 114 is sized to contain combustible gas in a second preselected quantity. The comparative volumes of tanks 112 and 114 are selected with consideration for available or chosen gas pressures under expected temperatures at point of use, to produce a suitable ratio of gases in the end mixture. As noted above, a suitable ratio for oxygen and propane is 5:1. Each accumulator tank holds a quantity of gas suitable to be combined in a mixture for a single operation of the exploder 100.

A sample calculation yields sample volumes of the gases and for the accumulator tanks for a single operational cycle of the exploder. The calculation shows an explosive yield for those volumes:

According to Boyles law, $V1\times(P1/P2)=V2$ where P1 and P2 are values expressed as p.s.i.a. If the oxygen tank volume is 2.76 cu.ft. with an operating pressure of 85 p.s.i.g., the volume of oxygen is 18.73 cu.ft. at standard temperature and pressure. If the propane tank volume is 3.47 cu.ft. at 19 p.s.i.g., the volume of propane is 7 cu.ft. at standard temperature and pressure. Commercial propane really is LP-gas or LPG (liquefied petroleum gases) and varies in heat of combustion yields due to the differing percentages of the constituent gases. These may include propane, butane, isobutane, propylene, butylenes and other light hydrocarbons occurring in the paraffin series between ethane and pentane.

Explosive yield for propane can be calculated using a value for heat of combustion of 2522 BTU/cu.ft. and the following conversion factors: 1 btu=1055.87 Joules; 1000 calories=1 g TNT; 1 calorie=4.1868 Joules; and 1 lb=453.59 g. Therefore, 7.048 cu.ft. of propane yields a theoretical equivalent to 9.883 lbs of TNT.

The theoretical ratio of propane to oxygen is approximately 5 volumes of oxygen to 1 volume of propane or 16.6 percent propane by volume. The theoretical ratio of propane to air is 4.02 percent propane by volume. Since the ratio of propane to oxygen in the preferred embodiment is 27 percent, then during testing, either atmospheric oxygen is making up the difference or a less than ideal combustion is occurring. The former seems to be the case due to the observed effectiveness of the detonation and apparent lack of excess residual propane.

Optionally, in order to operate the exploder repeatedly, each accumulator tank is associated with another source or larger reservoir supplying the appropriate gas, of suitable size to recharge the accumulator tank, repeatedly. Such an arrangement is best shown in the schematic view of FIG. 5. The oxygen accumulator tank 112 is fed from a reservoir of oxygen contained in an oxygen supply tank 116, which may be a commercial oxygen tank available from many sources. Such commercial tanks carry a mechanical shutoff valve and are configured for attachment to a standard oxygen regulator. An oxygen pressure regulator 118 is connected to oxygen supply tank 116 to control an allowed rate of oxygen flow from tank 116. An oxygen supply solenoid valve 120 is connected in-line with the regulator. Valve 120 is electrically opened to allow oxygen from supply tank 116 to charge accumulator tank 112. The solenoid valve 120 is spring loaded to closed position so that oxygen is not released accidentally, without the presence of an active electrical signal. The oxygen accumulator tank 112 should be suitably structured to receive and hold oxygen gas at a pressure from at least about fifty p.s.i.g. to about one hundred p.s.i.g.

The propane accumulator tank 114 is similarly fed from a larger reservoir of propane such as in a propane supply tank 124. This tank also is a standard commercial propane tank equipped with a mechanical shutoff valve and configured for attachment to a standard propane regulator. A propane regulator 126 is attached in-line with the regulator and controls an allowed rate of flow from propane supply tank 124 to accumulator tank 114. A propane supply solenoid valve 128 electrically opens to allow gas from supply tank 124 to charge accumulator tank 114. The solenoid valve 128 is spring loaded to closed position so that propane is not released accidentally. The propane accumulator tank should be suitable to receive and hold gas at a pressure of at least about nineteen p.s.i.g., which is typical of available propane gas pressures at cold, mountaintop temperatures.

An electronic control module 122 is functionally connected to the solenoid valve 120 in a suitable manner, such as by signal wire 121, to supply an electrical signal to selectively open the solenoid valve. The electronic control module 122 is functionally connected to the solenoid valve 128, such as by signal wire 129, to supply an electrical signal to selectively open valve 128. The control module causes these valves to close by terminating the signal. The described electric valves permit automated control over charging the accumulator tanks from the larger supply tanks.

The control module 122 may be a programmed general-purpose computer, controller, or other microprocessor-controlled device capable of carrying out programmed instructions and issuing electrical signals to control external electrical equipment. The electronic control module is preferred to be self-contained so that it can operate in remote areas. It is provided with a power supply to operate the module and supply necessary electrical signals and actuations. Suitable known interfaces are used, as allow a general-purpose computer or industrial control module to monitor and control chosen electrical equipment such as switches and valves. Suitable power sources include a battery or a solar panel, or, optionally, power from a utility grid, as may be available.

An optional pressure responsive means may regulate or monitor the charge in each of the accumulator tanks. As one option, the pressure responsive means is a transducer in each accumulator tank 112, 114; in the gas lines 138, 140; or in valves 120, 128, 158, 160 communicating with each of the accumulator tanks. As another option, a pressure-actuated switch will shut the gas valves 120, 128 at suitable preselected pressures, such as nineteen p.s.i.g. for a propane accumulator tank and eighty-five to one hundred p.s.i.g. for an oxygen accumulator tank. Each accumulator tank 112, 114 or valves 120, 128, 158, 160 optionally may incorporate a pressure switch 119, 127 that closes upon detecting a suitable pressure for the chosen component gas within the tank. Thus, an electronic monitoring system of control module 122 can determine, by reading the open or closed condition of such pressure switches 119, 127, when each accumulator tank 112, 114 contains a suitable charge of a chosen gas.

Alternatively, the pressure regulators 118, 126 can be used in place of a pressure switch. A pressure regulator can be preset for a selected maximum pressure of gas to monitor and control the filling process. For example, if a propane pressure regulator is set at nineteen p.s.i.g., the pressure regulator will limit the accumulator charge to the set pressure. A standard pressure regulator may lack facility to communicate with an electronic monitoring system of control module 122. Therefore, when a standard pressure regulator is used in place of a monitorable pressure switch, the process of filling an accumulator tank can be carried out over a surplus time period for the full charge to be delivered to the accumulator tank. A period of one minute typically will prove to be adequate for this purpose.

Nitrogen supply tank 130 is an optional but recommended component. Tank 130 contains a supply of nitrogen gas. Tank 130 may be a commercial nitrogen tank equipped with a mechanical shut-off valve and configured for attachment to a nitrogen regulator. A nitrogen pressure regulator 132 controls the rate of allowable nitrogen flow from tank 130. Optionally, a nitrogen supply solenoid valve 134 is connected in-line with the regulator to allow controller 122 to electrically release nitrogen gas. Released nitrogen flows through nitrogen supply line 136 to the accumulator valves, where it is a source of pneumatic power for operating the accumulator valves. Nitrogen gas can serve as a source of power for other purposes, as may be required.

Figure 2:
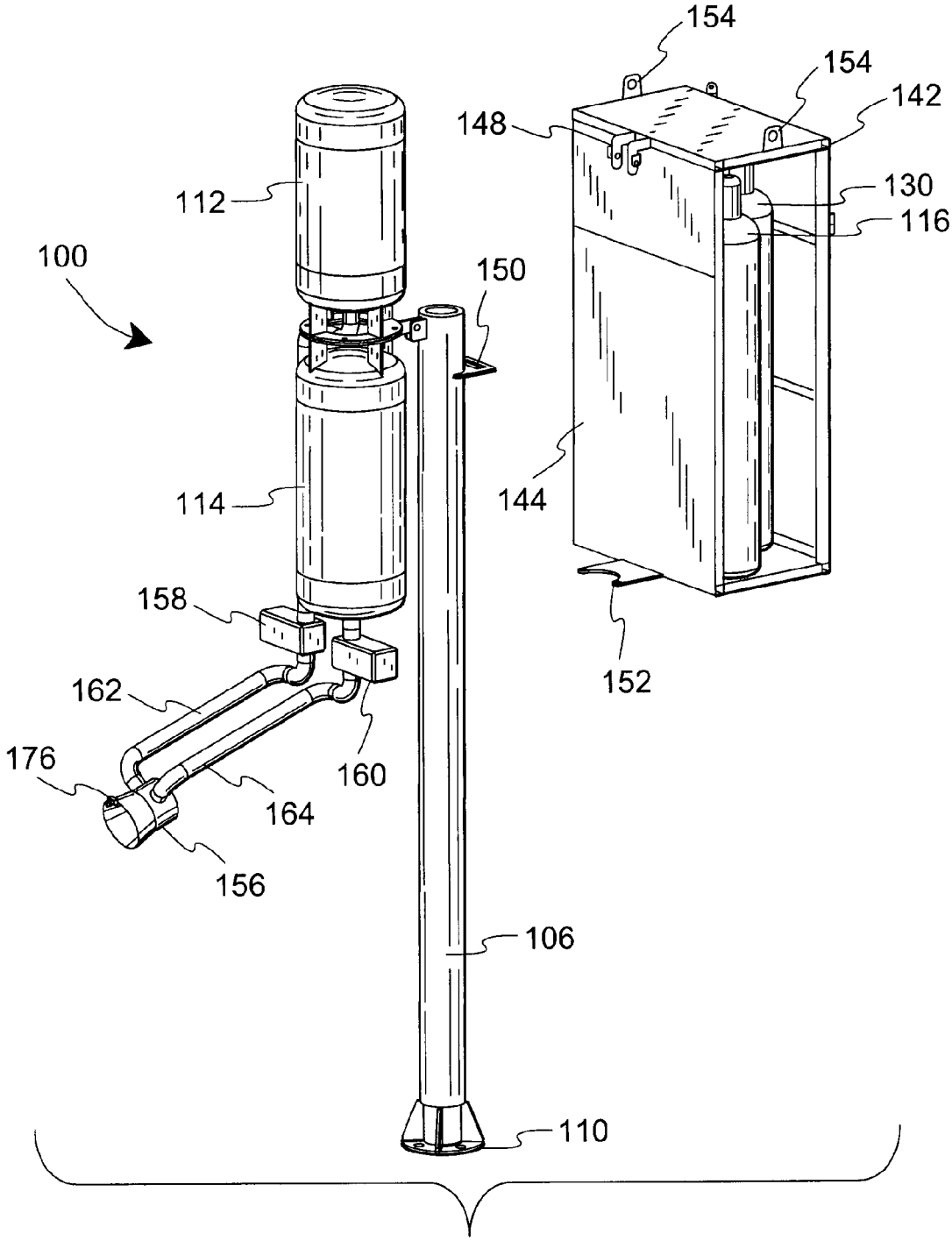
FIG. 2 is an isometric assembly view of the exploder and tank cage.
Figure 3:
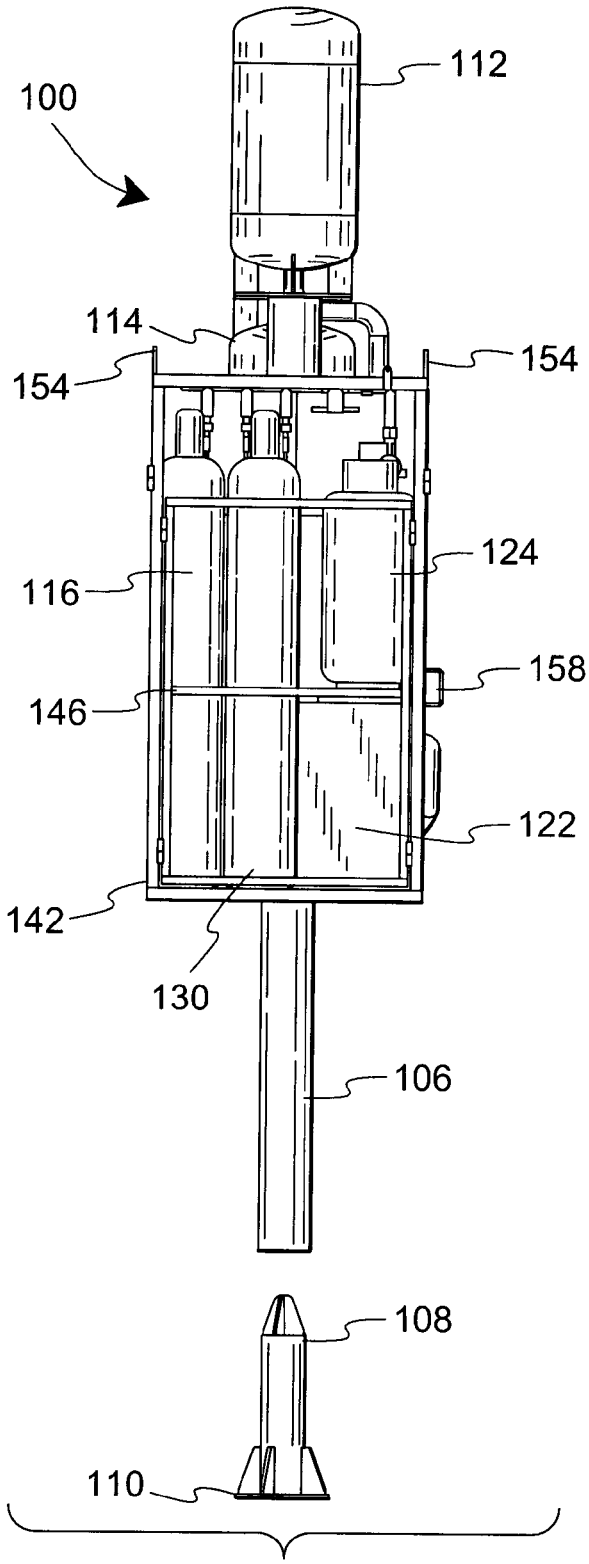
FIG. 3 is a rear assembly view of the exploder and mounting bullet base.

The gas supply tanks 116, 124 are connected to the accumulator tanks by respective feed lines 138, 140. The gas supply tanks may be located remotely from the mast 106, at a safe distance from the operation of the exploder and at a convenient location for periodically replacing exhausted tanks or for servicing a plurality of grouped exploder installations. As best shown in FIGS. 1-3, an alternative and preferred location for the gas supply tanks 116, 124, and 130 is mounted on mast 106. A housing or partially open cage 142 is mounted on one side of the mast 106, such as on the uphill or backside of the mast so that the mast helps to shield the cage from operational explosions of the exploder 100. The walls of cage 142 are formed with an open structure, such as a partially open mesh, so that any leaked gases cannot accumulate inside the cage. However, as best shown in FIG. 2, the front or mounting wall 144 of the cage may be a substantially imperforate or solid shield wall that further protects the contents of the cage from the force of operational explosions. Thus, the shield wall approximately faces the area where the gas mixture will be detonated.

Desirably, the gas supply tanks are adequate to provide a sufficient reservoir of respective gases for the needs of an entire winter or other period of service. Nevertheless, the cage can be serviced to replace spent gas supply tanks 116, 124, and 130 as necessary. For this purpose, the cage includes an openable or removable rear door 146 to allow removal and reinstallation of supply tanks. A combination of factors makes on-site servicing difficult during winter conditions. These factors include the often-remote location where the exploder may be installed, the deep snow that may surround the exploder, and the difficulty of transporting and installing bulky or heavy supplies to the exploder during heavy snow conditions. To overcome these factors, the cage is structured as a removable unit from the mast 106.

As best shown in FIG. 2, the cage 142 mounts on mast 106 by a gravity connection so that the housing can be removed through vertical lifting that disengages the connection. A suitable gravity connection is a hook and receptor system. A plurality of laterally separated hooks 148 on the cage 142 engages a laterally elongated receptor 150 on the mast to provide a stable mounting with fixed relative orientation. The cage is further stabilized on the mast 106 by a standoff 152. One or more lift eyes, such as the laterally spaced pair of lift eyes 154 at the top of cage 142, provide a means for lifting the cage and its contained tanks from mast 106 to enable replacement of the tanks. Another cage holding fresh tanks can be delivered to replace a removed cage having one or more spent tanks. A helicopter is a suitable vehicle for lifting or lowering such large or heavy objects as the cage at remote locations. Thus, the described mounting system between the mast 106 and cage 142 is adapted to allow the cage to be lifted from or lowered to the mast. Even during heavy snow conditions, ground maintenance workers should be able to reach the location by snow vehicle, skis, or other means in order to aid the replacement by disconnecting or reconnecting gas feed lines to the like and hooking or unhooking a helicopter winch line with eyes 154.

As thus far described, the replaceable cage 142 carries pressurized reservoir tanks of propane, oxygen, and nitrogen. Suitable regulators and electrically controlled valves 120, 128 enable and control the flow of oxygen and propane to gas quantity measuring devices such as the accumulator tanks 112, 114. Under control of a computer or other electronic control module 122, electrically controlled valves 120, 128 can be selectively opened to feed gases under pressure into the accumulator tanks, after which the valves 120, 128 close under a default force system such as a spring. The accumulator tanks 112 and 114 each are sized to hold a separate charge of gas in quantity sufficient to form an explosive mixture when mixed together, suitable for a single operation of the exploder 100.

According to one embodiment, the accumulator tanks 112, 114 selectively supply measured amounts of the combustible gas and the oxidizing gas at above-ambient pressures to a means for mixing gas, such as gas mixer 156 of FIGS. 1-5. A first accumulator valve 158 controls release of gas flow exiting the first accumulator tank 112; and a second accumulator valve 160 controls release of gas flow exiting the second accumulator tank 114.

As may be required, suitable oxygen conduit 162 and a propane conduit 164 connect oxygen accumulator tank 112 and propane accumulator tank 114 to the mixer 156 under control of the valves 158, 160. The accumulator tanks are oriented with discharge openings at their bottoms so that any residual gas will not pool or stagnate in these tanks after valves 158, 160 have released the gas charges. Thus, valves 158, 160 and conduits 162, 164 connect to the discharge openings at the tank bottoms and provide a downwardly open drainage pathway for any residual gases.

The best use of the electronic controller 122 employs a benchmark event to initiate timing to predict the movement of the gases from the supply until discharge to open air. Opening of one or more of the accumulator valves 158, 160 establishes such a reliable benchmark event. This benchmark time initiates a precalculated interval during which the component gases are released to the gas mixer 156, and this release timing can be either simultaneous or sequential according to such factors as relative lengths of conduits 162, 164 to ensure the gases reach the mixer at a suitable time to be mixed. When an accumulator valve 158, 160 is open, any gas within the associated accumulator tank at greater than atmospheric pressure will flow through the accumulator valve and conduit to mixer 156. Such flow is known to occur rapidly, at near sonic speed.

A variety of commercially produced valves, such as electric solenoid valves or pneumatic ball valve assemblies can be used as the accumulator valves. Preferred accumulator valve assemblies 158 and 160 are commercially available ball valves that are spring-loaded to open position and closed by pneumatic pressure. Many such valves require about 50 ms to fully open. For preferred operation of the exploder 100, the ball valve or other type valve used on the accumulators should close on command and open rapidly, within 100 ms, when commanded to open. Nitrogen gas from tank 130 may supply the pneumatic energy to close the pneumatic valves. Because the accumulator valves are mechanically biased open unless receiving gas pressure to close them, the accumulator tanks normally are vented to atmosphere. In default operation, due to loss of nitrogen pressure or loss of electricity, the valves are vented to atmosphere. During normal operation, an electrical signal from controller 122 triggers the valve assemblies 158, 160 to close, and the absence or termination of the electrical signal causes the valves to open.

The accumulator valve assemblies 158, 160 and the conduits 162, 164 should be large enough to allow the detonable gas mixture to form a contiguous cloud to the exploder 100 within the precalculated time interval, which is before ambient wind can dissipate the cloud. The full-accumulated charge of gases from the accumulator tanks 112, 114 should be able to discharge promptly, without undue friction from the valves or conduit. For this purpose, the diameter of the valve orifice in valve assemblies 158, 160, when open, is the same size or larger than the inner diameter of conduits 162, 164. For preferred operation of the exploder 100, a suitable nominal inner diameter of the conduit is two inches, which two-inch schedule 40 steel pipe offers. A smaller size pipe or valve orifice could overly restrict the flow of gases. Such undue restriction could slow the escape of gases to a sufficient degree that the full-accumulated charge of gases does not escape from the accumulator tanks quickly enough to form a contiguous cloud of explosive mix before ambient wind could dissipate the cloud. Therefore, the preferred nominal size of the accumulator valves and gas conduit is two inches or more.

For safety related reasons, a suitable accumulator valve assembly 158 on the oxygen accumulator tank 112 must not trap oxygen in any part of the valve mechanism. Trapped oxygen might form an explosive mixture with combustible dirt, oil, or grease. A suitable valve choice is a stainless steel ball valve that has been cleaned for oxygen and is rated for oxygen use. Similarly, all oxygen accumulator tanks, conduits, and fittings must be oil, grease and dirt free and specially cleaned for oxygen use.

As an example of a commercially available stainless steel ball valve that is suitable, DuraValve, Inc., 2331 Eastern Ave., Elk Grove, Ill. 60007, produces model DM240, which is a two-piece valve with full port and threaded ends. Electrical commands actuate this ball valve, and pneumatic pressure operates the valve. It is an industry-standard type of pneumatically actuated ball valve assembly.

As an example of how an industry standard valve may function within the exploder 100, a control line 159 runs from the electronic control module 122 to the ball valve assembly 158. The pressure regulated line 136 from the nitrogen tank 120 runs to the ball valve assembly 158. When the ball valve is to be closed, the control module 122 may transmit a suitable electrical signal to the ball valve assembly 158.

The electric signal from the control module 122 activates a small solenoid that is a component of the ball valve assembly. The solenoid pulls open a small, spring loaded poppet valve, which allows nitrogen from line 136 to push a lightly spring loaded pilot spool valve to an open position. The spool valve allows a large flow of nitrogen from the tank line 136 to enter a one hundred millimeter diameter piston actuator in the ball valve assembly. The piston accumulator causes a rack and pinion arrangement to rotate a splined shaft by 90 degrees. The splined shaft is coupled to the stem shaft of the two-inch ball valve and rotates the ball to closed position.

The ball valve is normally open until actuated. Control module 122 can cease sending the electrical signal to the ball valve assembly 158 in order to command the valve to open. Without the signal from the control module, power is removed from the small solenoid on the valve assembly and the small poppet valve closes under spring force. In turn, the lightly spring loaded pilot spool valve is returned to the closed position. This simultaneously shuts off the flow of nitrogen from the tank line 136 to the one hundred millimeter piston and vents remaining pressurized nitrogen in the one hundred millimeter cylinder to the atmosphere. The valve is returned to the normally open position by means of a set of return springs that are built into the one hundred millimeter piston housing and oppose the one hundred millimeter diameter piston travel. The piston had previously compressed the return springs upon actuation.

Accumulator valve 160 on the propane accumulator tank may operate in the same industry standard manner described above. A control line 161 runs from the control module 122 to the ball valve assembly 160 and provides a signal to close valve 160. Because of their speed and reliability, industry standard pneumatic valves are preferred. If another type of valve is used, such as an electric solenoid valve, the alternative valve should similarly close on command, open within the previously specified 100 ms limit, and open as the default valve position.

Figure 4:
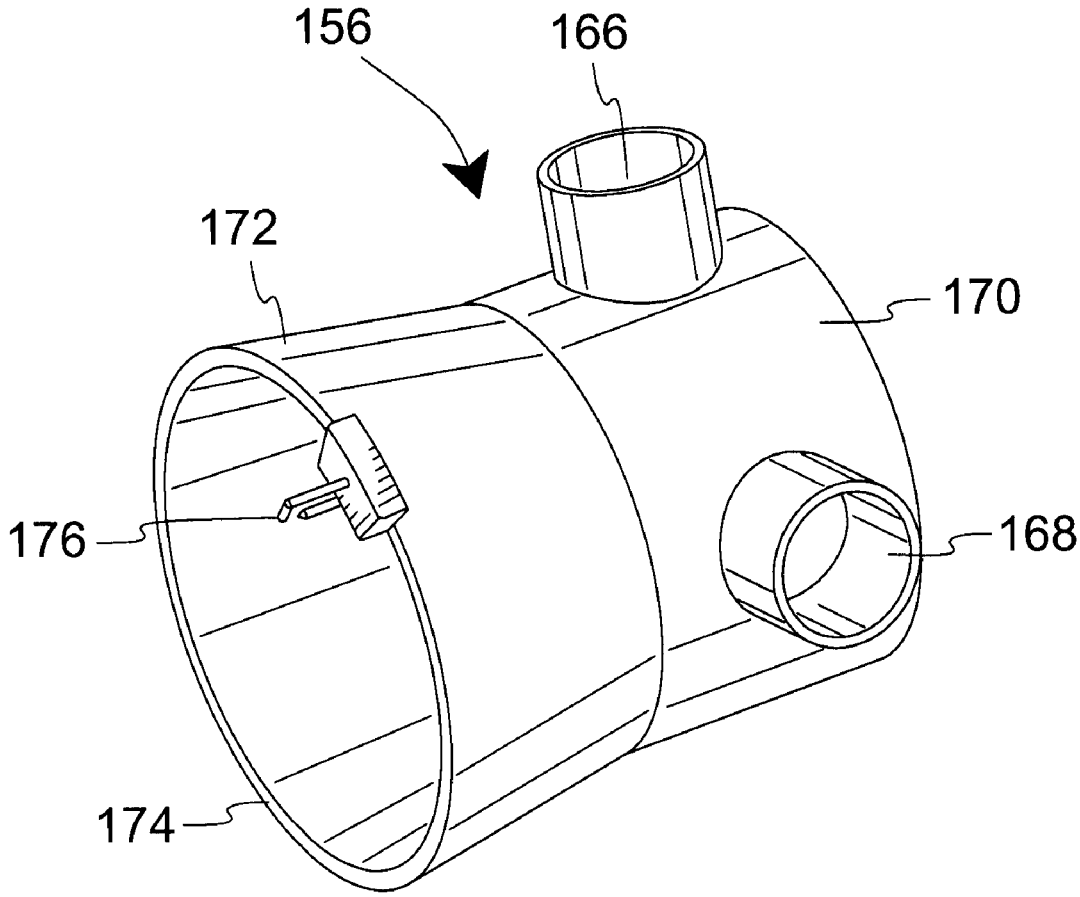
FIG. 4 is an enlarged detail isometric view of a mixer.
Figure 5:
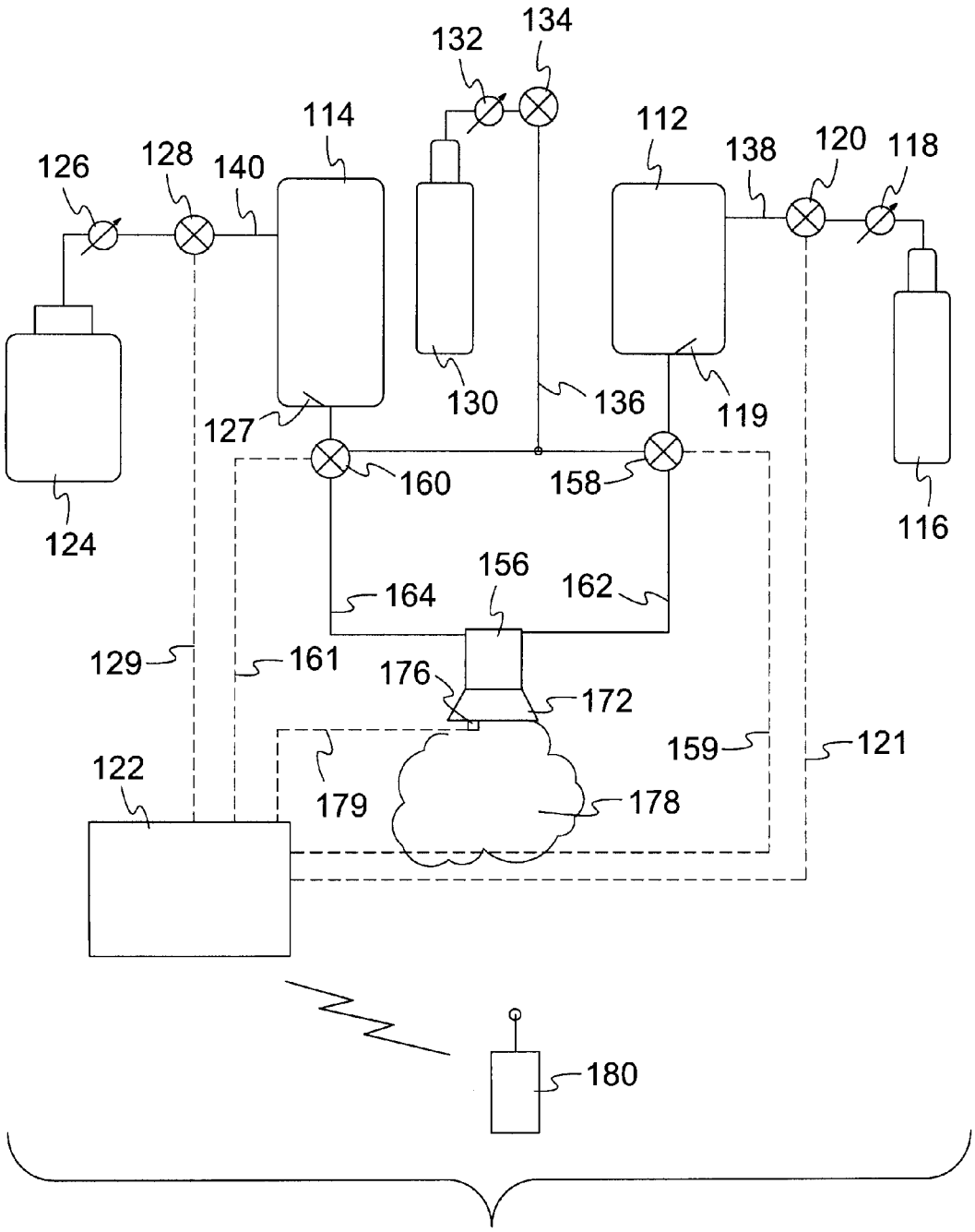
FIG. 5 is a schematic diagram of components of the exploder and connections thereof, with functional connections between an electronic control module and other components shown by broken lines.

The gas mixer 156 receives flow of pressurized gases from accumulator tanks 112 and 114 when accumulator valves 158, 160 are open. The flow is rapid, occurring at near sonic speeds at the valves 158, 160 and through the conduits 162, 164. With reference to FIG. 4, the mixer provides gas input ports 166, 168 that respectively connect to conduits 162, 164 and are nominally of the same inner diameter, i.e. two inches. The input ports receive and direct the oxygen and propane gases into a mixing chamber 170, where the oxidizing gas and combustible gas are combined to form a detonable gas mixture. The mixing chamber 170 may be a cylindrical chamber of larger diameter than the input ports 166, 168 or conduits 162, 164. For example, the mixing chamber may have an inside diameter of about eight inches and a height of about six inches, which provides room for the two gas streams to mix.

In mixer 156, the inlet ports are positioned to direct the gas streams from conduits 162, 164 through ports 166, 168 along intersecting or impinging pathways. Thus, for example, the ports are arranged at ninety degrees on the cylindrical sidewall of the mixing chamber 170. Streams of gas entering the mixing chamber through ports 166, 168 are turbulent and actively mix with one another.

The mixer 156 is open to atmosphere so that the mixed gas can discharge from it. The discharging mixed gas is directed to a known or substantially predictable open-air proximity to the mixer. Reference to a known or substantially predictable open-air proximity is time dependent. Typically, the time is several hundred milliseconds from release of the component gases from their source, i.e, from the accumulator tanks. A divergent nozzle 172 at an axial end of the mixing chamber 170 discharges and directs the detonable gas mixture to the open-air proximity from the mixing chamber. A lip 174 defines a mixing chamber exhaust port. The opposite axial end of the mixing chamber 170 is closed. The nozzle 172 to direct the gas cloud out of the mixer and into selected open-air proximity to the exploder.

The volume of mixed gas is substantially larger than the volume of the mixer. For example, the mixed gas may occupy about twenty-five cubic feet at standard temperature and pressure, while the mixer typically has a volume of less than one-half cubic foot. Thus, mixed gas in a single batch is rapidly and progressively discharged to open atmosphere through divergent nozzle 172.

The gas mixture expands to ambient pressure as its passes through nozzle 172 and into open air beyond. With such expansion, gas velocity decreases in open air. In the open air, the mixed gas undergoes additional mixing, including mixing with ambient air. Such additional mixing supplies supplemental oxygen from atmosphere to the mixture, which helps to ensure that sufficient oxygen will be available within the mixture to produce a powerful and efficient explosion.

The body of mixed gas exits the mixer at nozzle lip 174 and enters open-air proximity to the exploder. A means for igniting the mixed gas, such as a spark ignition unit 176, is located in the open-air proximity of the mixed gas cloud to the exploder. More specifically, the igniter 176 is located where the trailing portion of the gas cloud will be located at a time when the igniter is actuated, which is within a time interval measured from the benchmark release of gases from the accumulator tanks. The igniter may be juxtaposed to the mixer nozzle 172, such as by attachment to the outlet lip 174 or other predetermined position. When the igniter 176 is proximate to the exhaust port defined by lip 174, the igniter will be near the trailing edge of the discharging cloud. Thus, the igniter can detonate the cloud from its trailing edge, ensuring that the explosion takes place in open air. The igniter selectively provides a spark to ignite and detonate the gas cloud 178, schematically illustrated in FIG. 5.

Thus, the mixed gas cloud is discharged from the mixer in open-air proximity to the igniter, which is in a predetermined position. The shield wall 144 of cage 142 approximately faces this predetermined position near the mixer 156. The igniter should be proximate to the discharge port from the mixer or to the final portion of the mixing area for the component gases. When the mixer partially confines the component gases, as is the case with mixer 156, the discharge port at lip 174 provides a suitable predetermined position for carrying the igniter. Igniting the trailing portion of the mixture cloud is preferred because the detonation will propagate from the exploder toward the area of open air. Also, the location of the trailing portion as it exits the confinement of the mixer is reliable.

The electronic control module 122 is functionally connected to the igniter 176. For example, a wire 179 connects module 122 to the igniter for selectively firing the igniter. The electronic control module 122 coordinates the time for ignition from an earlier reference point, which is the benchmark opening of the accumulator valves 158, 160. The time interval necessary for movement of the gases from benchmark time until the mixed cloud has exited the mixer to open air is determinable. With suitable coordination, the mixed gas cloud reliably resides in the area of open atmosphere in communication with the predetermined position of the igniter.

The time for igniting the gas mixture is best determined by projecting the location of the gases with respect to time. The control module 122 may coordinate the release of each component gas so that the two gases arrive at the mixer substantially at the same time. As best shown in FIG. 2, the accumulator valves 158, 160 are located such that conduits 160, 162 are of approximately equal length between the valve and the mixer. The equal lengths and diameters should produce approximately equal resistance to gas flow. Equal resistance to flow over the length of the conduits conveniently permits the valves 158, 160 to be opened simultaneously. In the illustrated embodiment of FIGS. 1-3, the conduits 160, 162 may be about three feet in length, and the time delay from opening the accumulator valves until firing the igniter can be about 200 milliseconds. Conduits lengths could be extended to about thirty or forty feet from the accumulator valves to the mixer without significant flow restriction. With such longer conduit lengths, the suitable firing delay might be increased.

The described mixer 156 relies upon mixing between intersecting high-speed gas streams, aided by impingement of the gas streams on one or more walls of the mixing chamber 170. Other known types of gas mixers could be used. These include static mixers, entrainment mixers, and venturi mixers. The partially closed mixing chamber 170 of mixer 156 may be regarded as an optional convenience for supporting the gas conduits and igniter.

Mixing can be achieved in open air by aiming gas conduits 162, 164 to direct their discharging gas streams along intersecting vectors. Thus, the gas conduits 162, 164 may be supported in the configuration shown in FIG. 2, where the gas streams will intersect at ninety degrees. In the absence of a physical mixing chamber 170, the gas streams would mix in open air. Thus, the physical mixing chamber 170 is optional. An impingement plate such as one or more wall of chamber 170 can be used to assist open air mixing and to redirect the movement of the mixed gas cloud as required.

An intersection angle of less than ninety degrees between component gas streams could produce mixing while simultaneously directing the mixed gas cloud in a selected direction, such as toward an avalanche start zone. As noted, the ambient air itself serves as a barrier, thus causing turbulent mixing. Thus, mixing in open air is optionally possible. During and after mixing, or as the gas cloud enters open air, the speed of the gas cloud slows substantially due to encountering ambient air.

Within a partially confined mixing chamber 170 or substantially any other mixing arrangement, it is advisable that the gas streams not directly oppose one another, so that the higher pressure gas stream does not reverse flow of the lower pressure gas stream within a gas supply conduit. For example, oxygen conduit 162 should not direct oxygen, typically at a relatively higher pressure, into the lower pressure propane conduit 164. It would be undesirable to mix oxygen and propane within the propane conduit 162. Therefore, an impingement angle of ninety degrees or less is preferred between the discharging gas streams from the accumulator tanks.

Advantageously, the exploder 100 provides means for directing or delivering the mixed cloud to a position removed from the exploder. The exit port 174 or nozzle 172 can direct the gas cloud. As illustrated, the conduits 162, 164 carry the component gases away from mast 106 to gas mixer 156 that can be located remotely from the mast 106. The conduits 162, 164 may be either rigid or flexible. If rigid, the conduits may be connected to valves 158, 160 by pivot joints serving as a means for variably positioning the mixer. For example, the conduits can be pivoted to various angles of elevation to accommodate the level of snow pack. The discharge location from mixer, such as the discharge nozzle 172, should remain the low point in the gas pathway to avoid pooling. With suitably large diameter to prevent flow restriction, the conduits may be of selected increased length, including variably extendable lengths, to deliver the gases to a mixer at a more remote point for detonation.

If conduits 162, 164 are flexible hoses of variably selected lengths, the mixer 156 can be moved over the range permitted by hose length. Thus, a single mixer 156 can be placed to suit conditions at one or more avalanche zones. If a first detonation fails to trigger a snow slide, the mixer 156 can be repositioned so that a subsequent detonation can be applied from a different location in the slide initiation zone. Flexible hoses 162, 164 also permit the mixer to be disposed at variably selected heights, such as from a nearby tree or selectively placed pole. Any flexible hoses should be managed to avoid traps or low points where gases can pool.

As further illustrated, the conduits may direct the component gases to a selected elevation, such as downwardly from the accumulator tanks. Where the mixer 156 is employed, the orientation of the mixer and its discharge nozzle may direct and deliver the mixed gas cloud to a pre-selected location remote from mast 106. The mixer 156 and, optionally, additional portions of the exploder 100 may be disposed at a small angle to the mast 106. For example, the discharge opening of the mixer may be aimed downhill from the mast and toward a slide initiation zone of a known avalanche area. Such an angle is desirable for directing the detonable gas mixture toward an intended target area while, at the same time, preventing the gas mixture from engulfing the exploder 100.

The detonable gas mixture is discharged into airspace above the snow mantle 104. After a timed delay from the initiation of component gas discharge from the accumulator tanks, the electronic control module 122 causes the igniter 176 to become energized and detonate the mixed gas cloud. The time delay allows turbulence within the gas cloud to complete the mixing process. An appropriate time delay should produce a thorough mix while detonating the mixture before it can be dissipated or removed by wind.

Detonation produces a supersonic shockwave with a high overpressure front, which fractures the snow mantle beneath the explosion. A vacuum or low-pressure wave follows passage of the high-pressure shockwave. The vacuum lifts the snow layer 104, thereby initiating release of a snow slide.

The electronic control module 122 provides a microprocessor and suitable memory to carry out programmed instructions to control the timing and operation of the accumulator valves 158, 160; the gas supply solenoid valves 120 and 128; and the igniter 176. A remote device such as a handheld radio 180 forms a radio link to the control module 122. Through the radio link, avalanche control personnel may initiate execution of the programmed instructions and operate the exploder 100 from a safe distance. The programmed instructions close valves 158 and 160 by sending an appropriate signal to those valves. The control module then opens valves 120 and 128 for a suitable time to allow the gases to flow under pressure from the oxygen and propane supply tanks to the accumulator tanks 112, 114. After the suitable time interval, valves 120, 128 are allowed to close. Then, the control module 122 opens valves 158, 160, such as by ceasing to send a "close" signal so that, by default mode, the valves open. The accumulator tanks discharge their contents through the open valves 158, 160 to the mixer 156. The control module 122 optionally can open valves 158, 160 either simultaneously or according to a programmed sequence in order to control the relative time when the component gases will reach the mixer.

The programmed instructions also provide suitable time for the explosive gas mixture to discharge from the mixer to open air, although this time period is limited so that the gas cloud is not dissipated or removed by wind from open-air proximity to the igniter. The control module actuates the igniter 176 at a suitable time to initiate an open-air detonation of cloud 178 of the explosive mixture. A suitable time delay from the opening of accumulator valves 158, 160 until actuating the igniter allows a batch of explosive gas 178 to substantially discharge from the mixer. The igniter 176 can be actuated at a suitable time when a trailing portion of the explosive gas cloud is proximate to the predetermined position of the igniter.

The following Wind Speed Chart shows the possible displacement from the mixer of the mixed gas cloud at wind velocities ranging from 5 m.p.h. through 75 m.p.h. The igniter typically is fired in about 200 milliseconds from the opening of the accumulator valves. This timing is suitable to ignite the gas cloud at any of the shown wind speeds.

Wind Speed Chart

| M.p.h. | Ft/sec | In/sec | In/ms |
|---|---|---|---|
| 75 | 110.03 | 1320.30 | 1.32 |
| 70 | 102.69 | 1232.28 | 1.23 |
| 65 | 95.36 | 1144.26 | 1.14 |
| 60 | 88.02 | 1056.24 | 1.06 |
| 55 | 80.69 | 968.22 | 0.97 |
| 50 | 73.35 | 880.20 | 0.88 |
| 45 | 66.02 | 792.18 | 0.79 |
| 40 | 58.68 | 704.16 | 0.70 |
| 35 | 51.35 | 616.14 | 0.62 |
| 30 | 44.01 | 528.12 | 0.53 |
| 25 | 36.88 | 440.10 | 0.44 |
| 20 | 29.34 | 352.08 | 0.35 |
| 15 | 22.01 | 264.06 | 0.26 |
| 10 | 14.67 | 176.04 | 0.18 |
| 5 | 7.34 | 88.02 | 0.09 |

The residual velocity of the ignited gas cloud can carry the igniting explosive cloud 178 clear of the exploder 100 to open air. It is desirable to eliminate the explosion from the confines of the exploder 100 to reduce the shock borne by the exploder. The mounting of the exploder 100 primarily experiences an external shockwave from the open-air explosion, which the foundation and surrounding rock structures readily can tolerate.

Figure 6:
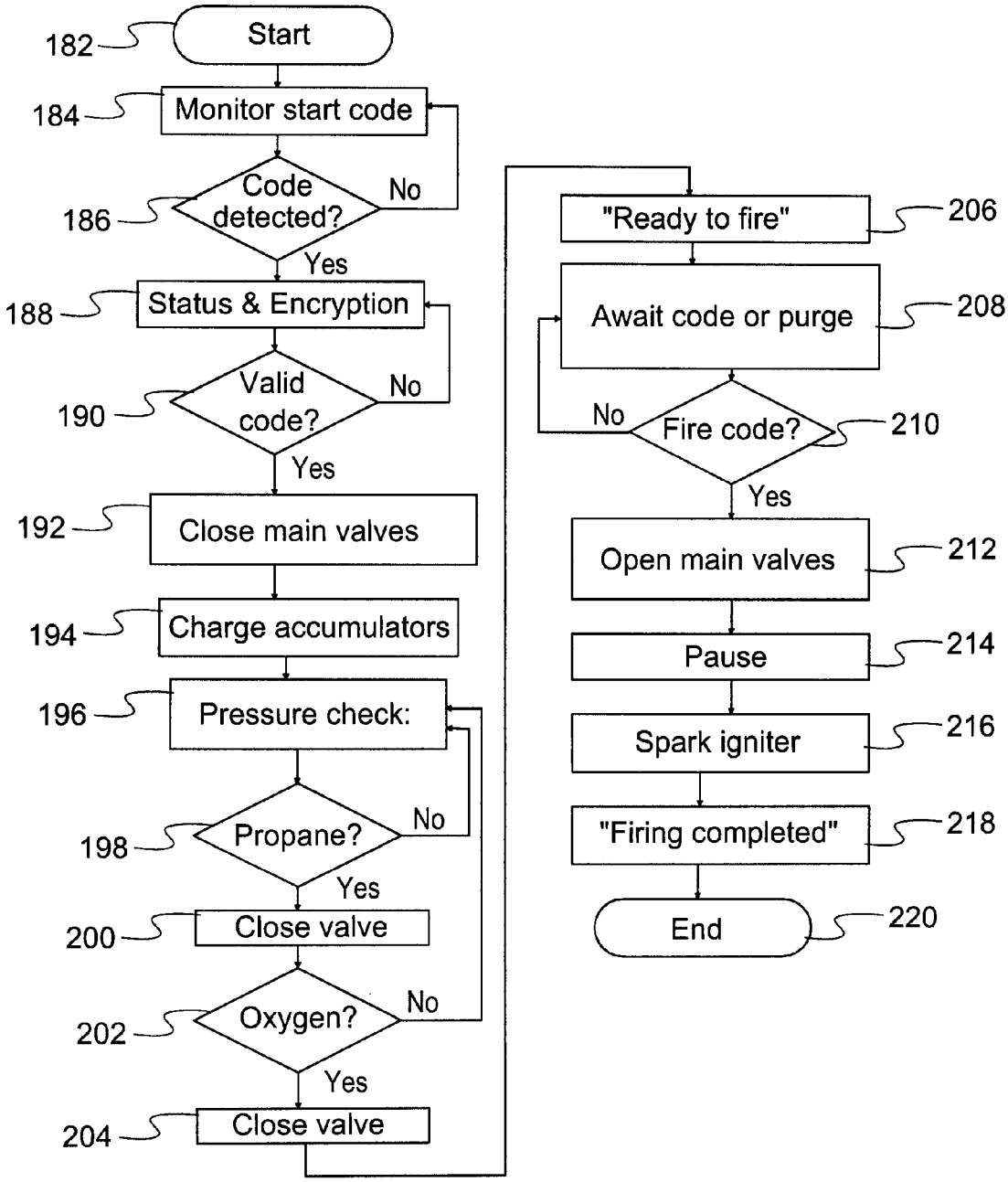
FIG. 6 is a flow chart showing control software and method steps in operating the exploder.

A method of operation relies upon the electronic control module 122, which is controlled by a microprocessor to execute programmed instructions for controlling the timing and operation of the valves and igniter. The remote radio 180 and the control module 122 communicate by a radio link. Together, they cooperate to execute a programmed routine according to software shown in flow chart form at FIG. 6. Module 122 runs the programmed instruction routine, with a starting point at block 182. A watchdog timer can operate to restart the microprocessor after any defined period when no code is being executed, such as after a power interruption. The microprocessor will then automatically boot up the software and start executing code at block 182.

The initial instruction produces a test loop that checks for reception of a valid radio code. At block 184, control module 122 monitors the radio link to a radio 180 for a start code, repeatedly checking at block 186 for a detected code and looping back to block 184 to check again if a code was not detected. When a start code is detected, processing advances to block 188 the module reports its status or other information stored in memory to the radio link. The status report may consist of error codes showing previously detected information held in memory. Examples are low battery power, low oxygen pressure, low propane pressure, or inoperative solar panel where a solar panel is used. For security, at block 190 the control module also requests encryption codes via the radio link. The radio link is monitored at block 190 for receipt of valid encryption codes, looping back to request these codes again if valid codes are not received. When valid encryption codes are received, processing advances to block 192.

In preparation for a detonation, at block 192 the control module closes the accumulator valves 158, 160 from the propane and oxygen accumulator tanks. At block 194, the gas supply valves 120, 128 are opened to allow gas from supply tanks 116, 124 to charge the accumulator tanks.

A pressure check at block 196 can confirm that an adequate charge is present in the accumulator tanks, but the processing in block 196, 198, and 202 is optional. The detonation process can continue at blocks 200 and 204. An attempted detonation without a pressure check is without significant adverse consequence. For example, if an accumulator tank is not adequately charged, the detonation may be small or may fail, in either case providing equivalent notice to an operator that the exploder requires service. The use of a pressure check at blocks 196, 198, and 202 is preferred so that operating personnel can isolate the reason why a detonation did not occur.

As one option, processing advances from block 194 to blocks 200 and 204, allowing a prior preselected time period, such as one minute, for the accumulator tanks to charge. Where the fixed charging time option is employed, gas supply valves 120, 128 are closed after the preselected period has elapsed.

As another option for charging the accumulator tanks, the control module monitors pressure switches at accumulator tanks 112, 114. At block 196 the control module reads whether the oxygen pressure switch 119 and the propane pressure switch 127 have closed, indicating that adequate charging pressure is present. For example, the pressure switch 127 in the propane tank may close at 19 p.s.i.g., providing a closed reading if this pre-selected minimum pressure is achieved. At block 198, the module checks for adequate propane charge by checking whether the propane pressure switch 127 is closed and loops back to block 196 if the switch remains open. If a closed pressure switch 127 is detected, the processor closes the propane supply valve 128 at block 200. Similarly and in parallel, the oxygen pressure switch 119 is checked at block 202, providing a closed reading when a suitable oxygen pressure, such as 85 p.s.i.g., is present. If the oxygen pressure switch 119 is not closed, processing returns to block 196. If the pressure switch 119 is closed, processing advances to block 204, where the processor closes the oxygen supply valve 120.

When the gas supply valves have been closed at blocks 200 and 204, processing advances to block 206 where the module 122 sends a "ready to fire" code to the radio link. At this point at block 208, the control module awaits receipt of a "fire" code from the radio link and, at block 210, checks whether such a "fire" code is received. If this code is not received, the program loops back to block 208 to further await receipt of the code. Block 208 also measures elapsed time since the "ready to fire" code was sent. If the elapsed time period is longer than a pre-established limit such as five minutes without receipt of the "fire" code, the control module purges the accumulator tanks and advances to block 220 to end the program cycle.

When ready to proceed, an operator supplies a "fire" code via the radio link. At block 210 the program detects receipt of the "fire" code. Processing advances to block 212, where the module 122 opens the accumulator tank valves 158, 160 to discharge the component gases to the mixer. As previously noted, these valves open in less than 100 ms. The gas charges then flow rapidly to the mixer and out the mixer nozzle as a mixed gas cloud. At block 214, the control module pauses for a suitable time delay interval such as 200 milliseconds for the component gases to reach the mixer, mix, and emerge to open air as the mixed gas cloud. The time delay is measured from block 212 and is sufficient that at least a portion of the gas cloud is positioned in communication with the igniter.

After the time delay has elapsed, at block 216 the control module energizes the igniter to spark for a suitable period, such as 0.5 seconds, to ignite the gas cloud for detonation. At block 218 the control module reports a "firing completed" code to the radio link so that the operator is aware the firing cycle has been completed. Finally, at block 220 the program cycle ends.

In a further embodiment, the handheld radio 180 is capable of communication with a plurality of exploders 106 in an array. By suitable programming, the radio link can fire a plurality of the exploders in a preselected sequence, which may include simultaneous firing. Thus, it becomes possible to generate complimentary shock waves in the area of the array. Shock waves can be generated in a reinforcing sequence, such that the second and subsequent detonations are cumulatively reinforced by the first and previous detonations.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. An apparatus for triggering an avalanche within a window of ambient weather conditions by an open air gas explosion of a batch mixture of at least first and second gases including an oxidizing gas and a combustible gas that when mixed together form an detonable gas mixture, comprising:

first and second sources of said respective first and second gases in volumes suitable to form a detonable mixed gas mixture effective for avalanche control, at gas pressures suitable to express the gases from said first and second sources at near sonic speeds;

first and second conduits for receiving said respective first and second gases from the respective first and second sources and for routing the gases to a substantially predictable open-air proximity, wherein said conduits are suitably configured with respect to said suitable gas pressures to carry the first and second gases to said open air proximity at near sonic speed;

means for mixing the gases to form a detonable gas mixture in the predictable open air proximity;

a selectively actuatable releasing means for releasing the gases from said sources to said conduits;

a selectively actuatable igniter located in communication with the predictable open air proximity, at a predictable trailing edge position relative to gas entry to the predictable open air proximity, for detonating said gas mixture by a trailing edge; and a controller, wherein:

said controller is in operable communication with said releasing means to selectively actuate the releasing means to release the gases;

the controller is in operable communication with said igniter for selectively actuating the igniter to detonate the gas mixture;

the controller includes a means for pausing between actuating the releasing means and actuating said igniter providing a suitable time for the gas mixture to enter the open air proximity while a trailing end thereof remains in spatial communication with the igniter when the controller actuates the igniter, and such that the detonable gas mixture has insufficient time to dissipate beyond the point of being an effective size of detonation for avalanche control within said window of ambient weather conditions;

wherein detonation of the detonable gas mixture takes place in an unenclosed environment.

2. The apparatus of claim 1, wherein said gas sources comprise:

gas measuring means for separately dispensing quantities of said oxidizing gas and combustible gas in a preselected approximate ratio, wherein said releasing means is connected to said measuring means to cause the gases to be dispensed in response to actuation of the releasing means.

3. The apparatus of claim 2, wherein said gas measuring means comprise first and second accumulator tanks, the first accumulator tank connected to said source of oxidizing gas and the second accumulator tank connected to said source of combustible gas.

4. The apparatus of claim 1, wherein said selectively actuatable releasing means comprises an electrically actuated valve.

5. The apparatus of claim 1, wherein:

said first and second sources of said respective first and second gases comprises a first accumulator tank containing an oxidizing gas and a second accumulator tank containing a combustible gas;

said selectively actuatable releasing means comprises a first valve on said first accumulator tank and a second valve on said second accumulator tank;

said means for mixing the gases is connected to said first and second valves and defines a discharge port for discharging said gas mixture for detonation; and said selectively actuatable igniter is connected to the means for mixing the gases;

further comprising:

a support structure carrying said first and second accumulator tanks, first and second valves, and means for mixing the gases, with the means for mixing the gases disposed with respect to said support structure such that said discharge port faces away from the support structure.

6. The apparatus of claim 5, wherein:

said first source of first gas is a first supply tank of oxidizing gas connected to said first accumulator tank and said second source of second gas is a second supply tank of combustible gas connected to said second accumulator tank;

a housing carries said first and second supply tanks, and said support structure carries the housing; and said housing includes a substantially imperforate shield wall that approximately faces said means for mixing the gases for shielding said first and second supply tanks from detonation of said discharged mixed gas.

7. The apparatus of claim 6, wherein said housing is connected to said support structure by a gravity connection such that the housing is removable by vertical lifting from the support structure.

8. The apparatus of claim 1, wherein said controller further comprises an electronic processor executing a sequence of programmed instructions including:

a first instruction to actuate said releasing means to release said first and second gases to form said detonable gas mixture and to discharge to said predictable open air proximity;

a second instruction to actuate said igniter to detonate the detonable gas mixture in open air; and wherein said means for pausing comprises:

an instruction to pause between execution of said first and second instructions for a time suitable for the released gases to form the detonable gas mixture and to discharge to said predictable open air proximity, but to execute the second instruction before the gas mixture dissipates in open air beyond the point of being an effective detonation for avalanche control.

9. The apparatus of claim 8, wherein said instruction to pause provides for an interval of less than a second.

10. The apparatus of claim 9, wherein said instruction to pause provides for an interval of several hundred milliseconds.

11. An apparatus for triggering an avalanche within a window of ambient weather conditions by an open air gas explosion of a batch mixture of at least an oxidizing gas and a combustible gas that, when mixed together, form an explosive gas mixture in quantity sufficient upon detonation for effective avalanche control, comprising:

a first dispensing means for supplying said oxidizing gas at a first pressure suitable to express the oxidizing gas upon release from said first dispensing means at near sonic velocity;

a second dispensing means for supplying said combustible gas at a second pressure suitable to express the combustible gas upon release from said second dispensing means at near sonic velocity;

a mixer receiving the oxidizing gas and the combustible gas upon release from said first and second dispensing means, mixing the combustible gas and the oxidizing gas to form said batch of explosive gas mixture, and discharging the batch of explosive gas mixture to a substantially predictable open-air proximity to the mixer at least initially at near sonic velocity;

a first releasing means for releasing the oxidizing gas from the first dispensing means to said mixer;

a second releasing means for releasing the combustible gas from the second dispensing means to the mixer;

igniting means positioned near said mixer in communication with said substantially predictable open-air proximity to the mixer for igniting said batch of explosive gas mixture in the substantially predictable open-air proximity to the mixer; and a controller actuating said first and second releasing means to release the at least two gases and actuating the igniting means to ignite the discharging batch of explosive gas mixture at a trailing edge thereof, providing a time interval on the order of a fraction of a second between actuating at least one of the releasing means and actuating the igniting means, wherein said time interval is suitably selected to ignite the explosive batch mixture by a trailing edge thereof while discharging to open air and before dissipation beyond the point of being an effective explosive mixture for avalanche control;

wherein explosion of the batch of explosive gas mixture takes place in an unenclosed environment.

12. The apparatus of claim 11, wherein:

said first and second releasing means comprise first and second electrically controlled valves said igniting means comprises an electrically fired igniter;

said actuating means includes means for sending an electrical signal to said releasing means at a first time, opening at least one of said electrically controlled valves, and means for sending an electrical signal to said igniting means at a second time firing the igniting means at a preselected time interval after said first time.

13. The apparatus of claim 11, further comprising:

discharge means for directing said explosive mixture from said mixer to a locale of substantially unconfined open air.

14. A method of avalanche control by detonating of a batch of explosive gas mixture in open air, comprising:

providing separate sources of at least two gases suited to form an explosive combination;

mixing said at least two gases at a first relative time to produce a batch of explosive gas mixture in a quantity sufficient to produce a detonation effective for avalanche control when ignited in open air;

directing said sufficient quantity of said explosive gas mixture with preselected velocity into a substantially predictable open air proximity such that the batch of explosive gas mixture occupies said open air proximity at a predictable second time subsequent to said first relative time;

locating an actuatable igniter in operative communication with the open air proximity such that said igniter is suitably positioned to ignite the batch of explosive gas mixture when actuated at the second predictable time; and actuating the igniter at the second predictable time to ignite the batch of explosive gas mixture in open air;

wherein detonation of the batch of explosive gas mixture takes place in an unenclosed environment.

15. The method of claim 14, wherein:

said step of directing said explosive gas mixture is performed directionally into said predictable open air proximity such that the mixture has a trailing edge at a substantially predictable location at said second predictable time;

said step of locating an actuatable igniter is performed by locating said igniter to be in operative communication with the batch of explosive gas mixture near said trailing edge at the second predictable time; and said step of actuating the igniter is performed by igniting the batch of explosive mixture from near the trailing edge of the batch of explosive gas mixture.

16. The method of claim 15, wherein:

said step of mixing said two gases is performed by releasing the two gases from said separate sources such that the gases mix; and further comprising:

providing a programmed controller executing a series of software instructions and operatively connected to selectively release the two gases from the separate sources and to actuate said igniter;

executing a software instruction releasing the two gases for mixing at a first relative time;

executing a software instruction actuating the igniter at a second relative time;

executing a software instruction causing a suitable pause after said first relative time and before said second relative time such that the second relative time is said second predictable time.

17. The method of claim 14, further comprising:

locating a mixer in proximity to an avalanche start zone; and wherein:

said step of providing separate sources of at least two gases is performed by containing a first of said two gases at a selectively opened first valve and containing a second of said two gases at a selectively opened second valve;

said step of mixing the two gases is performed by:

opening said first valve under conditions causing a first predetermined quantity of said first gas to flow through the first valve at a first velocity;

opening said second valve under conditions causing a second predetermined quantity of second gas to flow through the second valve at a second velocity; and routing said first and second predetermined quantities of gases through conduits of selected size to said mixer, thereby forming a batch of said explosive gas mixture; wherein said step of directing the gas mixture into a substantially predictable open air proximity is performed by directing said batch of explosive gas mixture to open air in proximity with respect to the avalanche start zone.

* * * * *